US010249245B1

(12) United States Patent
Hwang et al.

(10) Patent No.: US 10,249,245 B1
(45) Date of Patent: Apr. 2, 2019

(54) COMPENSATION SYSTEM AND COMPENSATION METHOD FOR AMOLED

(71) Applicant: Shenzhen China Star Optoelectronics Semiconductor Display Technology Co., Ltd., Shenzhen (CN)

(72) Inventors: Taijiun Hwang, Shenzhen (CN); Yuchao Zeng, Shenzhen (CN)

(73) Assignee: SHENZHEN CHINA STAR OPTOELECTRONICS SEMICONDUCTOR DISPLAY TECHNOLOGY CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 15/749,109

(22) PCT Filed: Dec. 19, 2017

(86) PCT No.: PCT/CN2017/117305
§ 371 (c)(1),
(2) Date: Jan. 30, 2018

(30) Foreign Application Priority Data

Nov. 22, 2017 (CN) ..... 2017 1 1177278

(51) Int. Cl.
*G09G 3/3258* (2016.01)

(52) U.S. Cl.
CPC ..... *G09G 3/3258* (2013.01); *G09G 2300/043* (2013.01); *G09G 2320/0276* (2013.01)

(58) Field of Classification Search
CPC ..... G09G 3/3258; G09G 2300/043; G09G 2320/0276
See application file for complete search history.

(56) References Cited

U.S. PATENT DOCUMENTS

2009/0058772 A1 3/2009 Lee
2013/0265344 A1 10/2013 Taniguchi
(Continued)

FOREIGN PATENT DOCUMENTS

CN 104464626 A 3/2015
CN 105096824 A 11/2015
(Continued)

*Primary Examiner* — Dmitriy Bolotin
(74) *Attorney, Agent, or Firm* — Leong C. Lei

(57) ABSTRACT

The present invention provides a compensation system and a compensation method for AMOLED display. In the system, the initial grayscale data is inputted into the grayscale data converting unit, the initial grayscale data is converted into the initial driving voltage data corresponding to the initial grayscale data by the grayscale data converting unit, and the initial grayscale data is transmitted to the compensation unit; the compensation unit compensates the initial driving voltage data by using the compensation ratio coefficient and the compensation voltage data in the compensation data storage unit and outputs the compensation driving voltage data to the voltage data conversion unit; the voltage data conversion unit then converts the compensation driving voltage data into the compensation grayscale data and outputs the compensation grayscale data to the source driver of the AMOLED display to uniformly compensate the AMOLED display by compensating the initial driving voltage data, which is capable of reducing the required data amount of compensation.

11 Claims, 7 Drawing Sheets

(56) References Cited

U.S. PATENT DOCUMENTS

| | | | | |
|---|---|---|---|---|
| 2014/0176400 | A1* | 6/2014 | Park | G09G 3/3233 345/76 |
| 2014/0184671 | A1* | 7/2014 | Lee | G09G 3/006 345/697 |
| 2016/0240128 | A1* | 8/2016 | Kim | G09G 3/2007 |
| 2016/0267876 | A1* | 9/2016 | Kim | G09G 5/10 |
| 2017/0169758 | A1* | 6/2017 | Park | G09G 3/2003 |
| 2017/0193959 | A1* | 7/2017 | No | G09G 3/3688 |

FOREIGN PATENT DOCUMENTS

| | | | |
|---|---|---|---|
| CN | 105469769 | A | 4/2016 |
| CN | 105529011 | A | 4/2016 |
| CN | 106205536 | A | 12/2016 |
| CN | 107316601 | A | 11/2017 |

* cited by examiner

COMPENSATION SYSTEM AND COMPENSATION METHOD FOR AMOLED

BACKGROUND OF THE INVENTION

Field of Invention

The present invention relates to the field of display technology, and more particularly to a compensation system and a compensation method for AMOLED.

Description of Prior Art

The Organic Light Emitting Display (OLED) possesses many outstanding properties of self-illumination, low driving voltage, high luminescence efficiency, short response time, high clarity and contrast, near 180° view angle, wide range of working temperature, applicability of flexible display and large scale full color display. The OLED is considered as the most potential display device.

The OLED can be categorized into a passive matrix OLED (PMOLED) and an active matrix OLED (AMOLED), i.e. the direct addressing and the Thin Film Transistor (TFT) matrix addressing. AMOLED has a matrix arrangement of pixels, belonging to the active display type with high luminous efficiency, usually for high-definition and large-size display device.

The OLED is a current-driven device. When a current flows through the OLED, the OLED emits light, and the light-emitting brightness is determined by the current flowing through the OLED itself. Most of the existing integrated circuits (ICs) only transmit voltage signals, so the pixel driving circuit of the AMOLED needs to complete the task of converting voltage signals into current signals.

Please refer to FIG. 1, a pixel driving circuit of AMOLED with a 2T1C structure of a conventional art, which comprises a first TFT T1, a second TFT T2, a capacitor C1 and an OLED D1. The gate electrode of the first TFT T1 is connected with the scanning signal Scan, the source electrode is connected with the data signal Data, and the drain electrode is electrically connected with the gate electrode of the second TFT T2. The drain electrode of the second TFT T2 is connected with the high potential power supply OVDD, the source electrode is electrically connected with the anode of the OLED D1. The cathode of the OLED D1 is connected with the low potential power supply OVSS. Both ends of the capacitor C1 are respectively and electrically connected with the gate electrode and the source electrode of the second TFT T2. The second TFT T2 is a driving TFT. During operation, the data signal Data is written into the gate electrode of the second TFT T2. The current flows through the second. TFT T2 and the OLED D1 to make the OLED D1 emit light. When the driving TFT operates in the saturation region, the current flowing through the driving TFT is:

$Ids=k(Vgs-Vth)^2$. Ids is the current flowing through the driving TFT, k is the intrinsic conducting factor of the driving TFT, Vgs is the voltage difference between the gate electrode and the source electrode of the driving TFT, Vth is the threshold voltage of the driving TFT.

The brightness formula of the OLED is:

$L=\eta\times I_{oled}$. L is the light-emitting brightness of the OLED, $\eta$ is the light-emitting coefficient of the OLED, and $L_{oled}$ is the current flowing through the OLED.

Because the OLED and the driving TFT are connected in series in the 2T1C pixel driving circuit, it can be seen from the above two equations that $L=\eta\times k(Vgs-Vth)^2$.

Because the threshold voltage of the driving TFT in each pixel is different from the intrinsic conducting factor and the light emitting coefficient of the OLED, the brightness of the AMOLED display will have unevenness even if the voltage difference between the gate electrode and the source electrode of the driving TFT is the same. Therefore, AMOLED displays need to be compensated for better display.

SUMMARY OF THE INVENTION

An object of the present invention is to further provide a compensation system for active-matrix organic light-emitting diode (AMOLED) display, which is capable of achieving the uniform compensation to the AMOLED, and the required data amount of compensation is little.

Another object of the present invention is to further provide a compensation method for AMOLED display, which is capable of achieving the uniform compensation to the AMOLED, and the required data amount of compensation is little.

In order to achieve the object, the present invention provides a compensation system for AMOLED display, which comprises a grayscale data conversion unit, a compensation unit electrically connected with the grayscale data conversion unit, a compensation data storage unit electrically connected with the compensation unit, a voltage data conversion unit electrically connected with the compensation unit. The voltage data conversion unit is electrically connected with a source driver of the AMOLED display. The compensation data storage unit stores compensation voltage data and compensation ratio coefficient.

The grayscale data converting unit is configured to input initial grayscale data and convert the initial grayscale data into initial driving voltage data corresponding to the initial grayscale data and transmit the initial driving voltage data to the compensation unit.

The compensation unit is configured to compensate the initial driving voltage data transmitted by the grayscale data conversion unit by using the compensation ratio coefficient and the compensation voltage data in the compensation data storage unit and output the compensation driving voltage data to the voltage data conversion unit.

The voltage data conversion unit is configured to convert the compensation driving voltage data transmitted by the compensation unit into compensation grayscale data and output the compensation grayscale data to the source driver of the AMOLED display.

The grayscale data conversion unit and the voltage data conversion unit both store a plurality of binding point grayscales and a plurality of binding point voltage data respectively corresponding to the plurality of binding point grayscales.

After the initial grayscale data is received by the grayscale data converting unit. When the initial grayscale data is the same as one of the plurality of binding point grayscales, the grayscale data converting unit outputs the binding point voltage data as the initial driving voltage data, the binding point voltage data is corresponding to the binding point grayscale which is the same as the initial grayscale data; and when the initial grayscale data and the plurality of binding point grayscales are not the same, the grayscale data conversion unit linearly interpolates the two binding point voltage data corresponding to the two binding point grayscales adjacent to the initial grayscale data, the initial driving voltage data corresponding to the initial grayscale data is calculated and outputted.

After the voltage data conversion unit receives the compensation driving voltage data transmitted by the compensation unit. When the compensation driving voltage data is the same as one of the plurality of binding point voltage data, the voltage data converting unit outputs the binding point grayscale as the compensation grayscale data to the source driver of the AMOLED display, the binding point grayscale is corresponding to the binding point voltage data which is the same as the compensation grayscale data; and when the compensation driving voltage data and the plurality of binding point voltage data are not the same, the voltage data conversion unit linearly interpolates the two binding point grayscales corresponding to the two binding point voltage data adjacent to the compensation driving voltage data, the compensation grayscale data corresponding to the compensation driving voltage data is calculated and outputted to the source driver of the AMOLED display.

The grayscale data conversion unit and the voltage data conversion unit both store 9 binding point grayscales and 9 binding point voltage data respectively corresponding to the 9 binding point grayscales; the 9 binding point grayscales are respectively $2^N-1$, $2^N\times 7/8$, $2^N\times 3/4$, $2^N\times 5/8$, $2^N\times 1/2$, $2^N\times 3/8$, $2^N\times 1/4$, $2^N\times 1/8$, and 0. N is a positive integer, a bit width of the initial grayscale data is N bit. The 9 binding point voltage data are: a first binding point voltage data, a second binding point voltage data, a third binding point voltage data, a fourth binding point voltage data, a fifth binding point voltage data, a sixth binding point voltage data, a seventh binding point voltage data, an eighth binding point voltage data, and a ninth binding point voltage data, which are sequentially decreasing.

The first binding point voltage data, the second binding point voltage data, the third binding point voltage data, the fourth binding point voltage data, the fifth binding point voltage data, the sixth binding point voltage data, the seventh binding point voltage data, the eighth binding point voltage data, and the ninth binding point voltage data are derived by respectively encoding a first binding point voltage, a second binding point voltage, a third binding point voltage, a fourth binding point voltage, a fifth binding point voltage, a sixth binding point voltage, a seventh binding point voltage, an eighth binding point voltage, and a ninth binding point voltage, which are corresponding to $2^N-1$, $2^N\times 7/8$, $2^N\times 3/4$, $2^N\times 5/8$, $2^N\times 1/2$, $2^N\times 3/8$, $2^N\times 1/4$, $2^N\times 1/8$, and 0. An encoding range, an encoding step, an encoding bit width, and Vref1 of the first binding point voltage, the second binding point voltage, the third binding point voltage, the fourth binding point voltage, the fifth binding point voltage, the sixth binding point voltage, the seventh binding point voltage, the eighth binding point voltage, and the ninth binding point voltage are 0–Vref1, $Vref1/2^n$, n bit without signed number, and a first preset reference voltage. n is a positive integer.

The compensation voltage data is obtained by encoding a preset compensation voltage. The encoding step of the first binding point voltage, the second binding point voltage, the third binding point voltage, the fourth binding point voltage, the fifth binding point voltage, the sixth binding point voltage, the seventh binding point voltage, the eighth binding point voltage, and the ninth binding point voltage is the same as an encoding step of the preset compensation voltage.

An encoding range, the encoding step, an encoding bit width, and Vref2 of the preset compensation voltage are −Vref2–Vref2, $Vref2/2^{m-1}$, m bit with signed numbers, and a second preset reference voltage. m is a positive integer.

When the compensation unit compensates the initial driving voltage data transmitted by the grayscale data conversion unit by using the compensation ratio coefficient and the compensation voltage data, the compensation voltage data and the initial driving voltage data are complement-added.

The present invention further provides a compensation method for AMOLED display, which is applied in the compensation system for AMOLED display as mentioned above, which comprises:

Step S1, the initial grayscale data is inputted to the grayscale data conversion unit, the initial grayscale data is converted into the initial driving voltage data corresponding to the initial grayscale data by the grayscale data conversion unit, and is transmitted to the compensation unit.

Step S2, the initial driving voltage data is compensated by using the compensation ratio coefficient and the compensation voltage data in the compensation data storage unit with the compensation unit and the compensation driving voltage data is outputted to the voltage data conversion unit.

Step S3, the compensation driving voltage data is converted into the compensation grayscale data by the voltage data conversion unit, and is outputted to the source driver of the AMOLED display.

The present invention further provides a compensation system for AMOLED display, which comprises a grayscale data conversion unit; a compensation unit electrically connected with the grayscale data conversion unit, a compensation data storage unit electrically connected with the compensation unit, a voltage data conversion unit electrically connected with the compensation unit. The voltage data conversion unit is electrically connected with a source driver of the AMOLED display. The compensation data storage unit stores compensation voltage data and compensation ratio coefficient.

The grayscale data converting unit is configured to input initial grayscale data and convert the initial grayscale data into initial driving voltage data corresponding to the initial grayscale data and transmit the initial driving voltage data to the compensation unit.

The compensation unit is configured to compensate the initial driving voltage data transmitted by the grayscale data conversion unit by using the compensation ratio coefficient and the compensation voltage data in the compensation data storage unit and output the compensation driving voltage data to the voltage data conversion unit.

The voltage data conversion unit is configured to convert the compensation driving voltage data transmitted by the compensation unit into compensation grayscale data and output the compensation grayscale data to the source driver of the AMOLED display.

The grayscale data conversion unit and the voltage data conversion unit both store a plurality of binding point grayscales and a plurality of binding point voltage data respectively corresponding to the plurality of binding point grayscales.

After the initial grayscale data is received by the grayscale data converting unit. When the initial grayscale data is the same as one of the plurality of binding point grayscales, the grayscale data converting unit outputs the binding point voltage data as the initial driving voltage data, the binding point voltage data is corresponding to the binding point grayscale which is the same as the initial grayscale data; and when the initial grayscale data and the plurality of binding point grayscales are not the same, the grayscale data conversion unit linearly interpolates the two binding point voltage data corresponding to the two binding point grayscales adjacent to the initial grayscale data, the initial driving voltage data corresponding to the initial grayscale data is calculated and outputted.

After the voltage data conversion unit receives the compensation driving voltage data transmitted by the compensation unit. When the compensation driving voltage data is the same as one of the plurality of binding point voltage data, the voltage data converting unit outputs the binding point grayscale as the compensation grayscale data to the source driver of the AMOLED display, the binding point grayscale is corresponding to the binding point voltage data which is the same as the compensation grayscale data; and when the compensation driving voltage data and the plurality of binding point voltage data are not the same, the voltage data conversion unit linearly interpolates the two binding point grayscales corresponding to the two binding point voltage data adjacent to the compensation driving voltage data, the compensation grayscale data corresponding to the compensation driving voltage data is calculated and outputted to the source driver of the AMOLED display.

The grayscale data conversion unit and the voltage data conversion unit both store 9 binding point grayscales and 9 binding point voltage data respectively corresponding to the 9 binding point grayscales; the 9 binding point grayscales are respectively $2^N-1$, $2^N\times 7/8$, $2^N\times 3/4$, $2^N\times 5/8$, $2^N\times 1/2$, $2^N\times 3/8$, $2^N\times 1/4$, $2^N\times 1/8$, and 0. N is a positive integer, a bit width of the initial grayscale data is N bit. The 9 binding point voltage data are: a first binding point voltage data, a second binding point voltage data, a third binding point voltage data, a fourth binding point voltage data, a fifth binding point voltage data, a sixth binding point voltage data, a seventh binding point voltage data, an eighth binding point voltage data, and a ninth binding point voltage data, which are sequentially decreasing.

The first binding point voltage data, the second binding point voltage data, the third binding point voltage data, the fourth binding point voltage data, the fifth binding point voltage data, the sixth binding point voltage data, the seventh binding point voltage data, the eighth binding point voltage data, and the ninth binding point voltage data are derived by respectively encoding a first binding point voltage, a second binding point voltage, a third binding point voltage, a fourth binding point voltage, a fifth binding point voltage, a sixth binding point voltage, a seventh binding point voltage, an eighth binding point voltage, and a ninth binding point voltage, which are corresponding to $2^N-1$, $2^N\times 7/8$, $2^N\times 3/4$ $2^N\times 5/8$, $2^N\times 1/2$, $2^N\times 3/8$, $2^N\times 1/4$, $2^N\times 1/8$, and 0. An encoding range, an encoding step, an encoding bit width, and Vref1 of the first binding point voltage, the second binding point voltage, the third binding point voltage, the fourth binding point voltage, the fifth binding point voltage, the sixth binding point voltage, the seventh binding point voltage, the eighth binding point voltage, and the ninth binding point voltage are 0–Vref1, $Vref1/2^n$, n bit without signed number, and a first preset reference voltage. n is a positive integer.

The compensation voltage data is obtained by encoding a preset compensation voltage. The encoding step of the first binding point voltage, the second binding point voltage, the third binding point voltage, the fourth binding point voltage, the fifth binding point voltage, the sixth binding point voltage, the seventh binding point voltage, the eighth binding point voltage, and the ninth binding point voltage is the same as an encoding step of the preset compensation voltage.

The beneficial effects of the present invention are: The present invention provides a compensation system for AMOLED display, the initial grayscale data is inputted into the grayscale data converting unit, the initial grayscale data is converted into the initial driving voltage data corresponding to the initial grayscale data by the grayscale data converting unit, and the initial grayscale data is transmitted to the compensation unit; the compensation unit compensates the initial driving voltage data by using the compensation ratio coefficient and the compensation voltage data in the compensation data storage unit and outputs the compensation driving voltage data to the voltage data conversion unit; the voltage data conversion unit then converts the compensation driving voltage data into the compensation grayscale data and outputs the compensation grayscale data to the source driver of the AMOLED display to uniformly compensate the AMOLED display by compensating the initial driving voltage data, which is capable of reducing the required data amount of compensation. The present invention provides a compensation method for AMOLED display, which is capable of achieving the uniform compensation to the AMOLED, and the required data amount of compensation is little.

BRIEF DESCRIPTION OF THE DRAWINGS

For further understanding of the features and technical contents of the present invention, reference should be made to the following detailed description and accompanying drawings of the present invention. However, the drawings are for reference only and are not intended to limit the present invention.

In drawings.

DETAILED DESCRIPTION OF THE PREFERRED EMBODIMENTS

Figure 1:
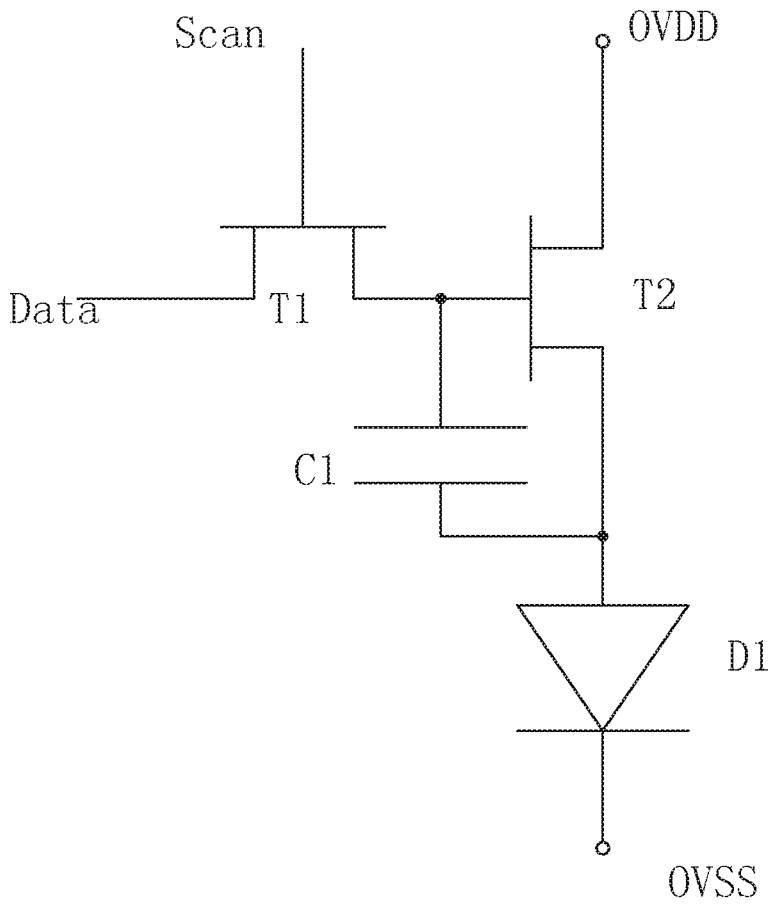
FIG. 1 is a circuit diagram of a conventional 2T1C AMOLED pixel driving circuit.
Figure 2:
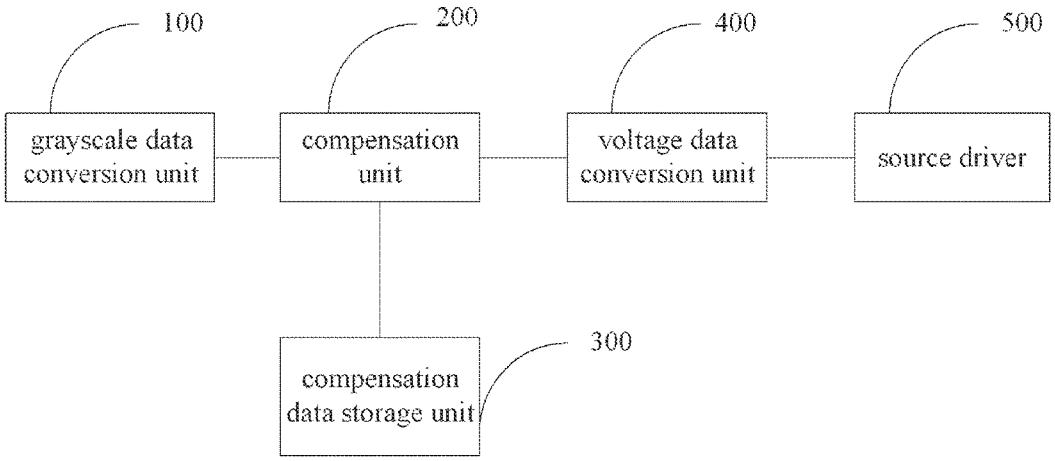
FIG. 2 is a structural illustrative diagram of a compensation system for AMOLED display according to the present invention.
Figure 3:
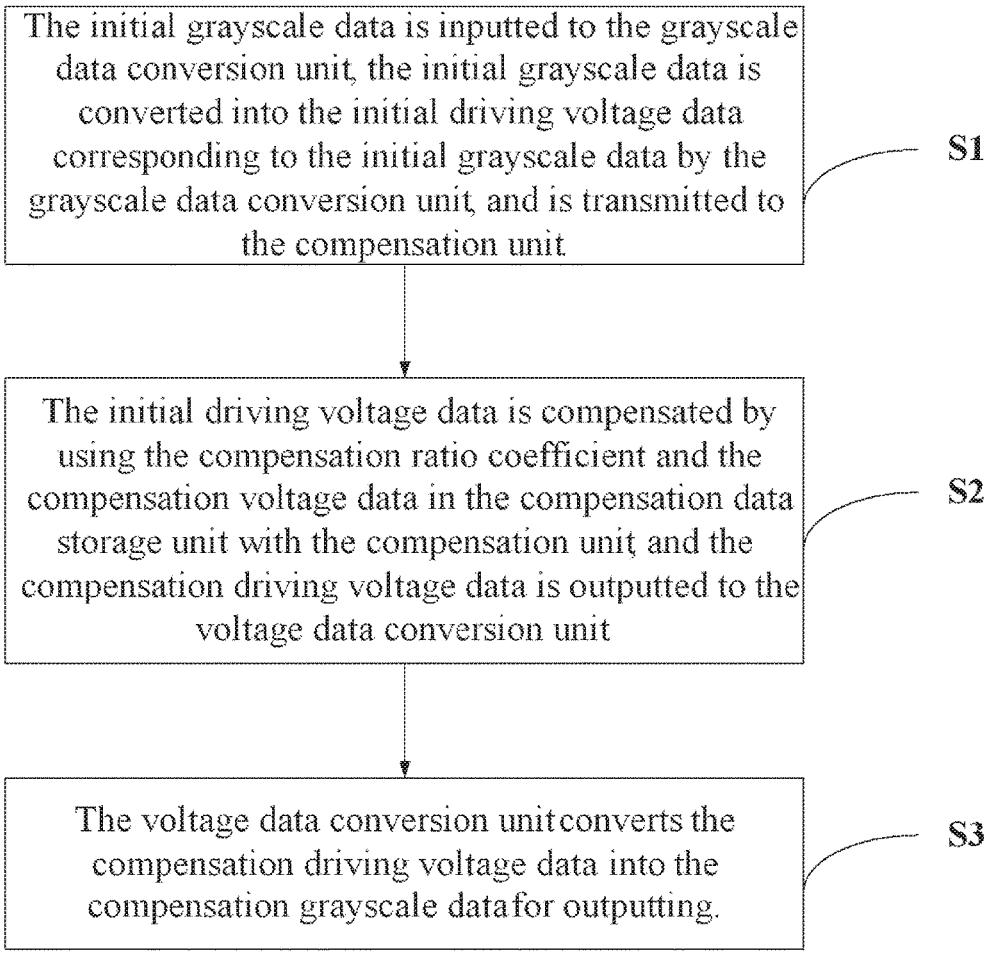
FIG. 3 is a flowchart of a compensation method for AMOLED display according to the present invention.

To further illustrate the technical solutions adopted by the present invention and the effects thereof, the following describes the preferred embodiments of the present invention and the accompanying drawings in detail.

Please refer to FIG. 2 and FIGS. 4-7, the present invention provides a compensation system for AMOLED display, which comprises a grayscale data conversion unit 100, a compensation unit 200 electrically connected with the grayscale data conversion unit 100, a compensation data storage unit 300 electrically connected with the compensation unit 200, a voltage data conversion unit 400 electrically connected with the compensation unit 200. The voltage data conversion unit 400 is electrically connected with a source driver 500 of the AMOLED display. The compensation data storage unit 300 stores compensation voltage data ΔVth and compensation ratio coefficient.

The grayscale data converting unit 100 is configured to input initial grayscale data and convert the initial grayscale data into initial driving voltage data corresponding to the initial grayscale data and transmit the initial driving voltage data to the compensation unit 200.

The compensation unit 200 is configured to compensate the initial driving voltage data transmitted by the grayscale data conversion unit 100 by using the compensation ratio coefficient and the compensation voltage data ΔVth in the compensation data storage unit 300 and output the compensation driving voltage data to the voltage data conversion unit 400.

The voltage data conversion unit 400 is configured to convert the compensation driving voltage data transmitted by the compensation unit 200 into compensation grayscale data and output the compensation grayscale data to the source driver 500 of the AMOLED display.

Figure 4:
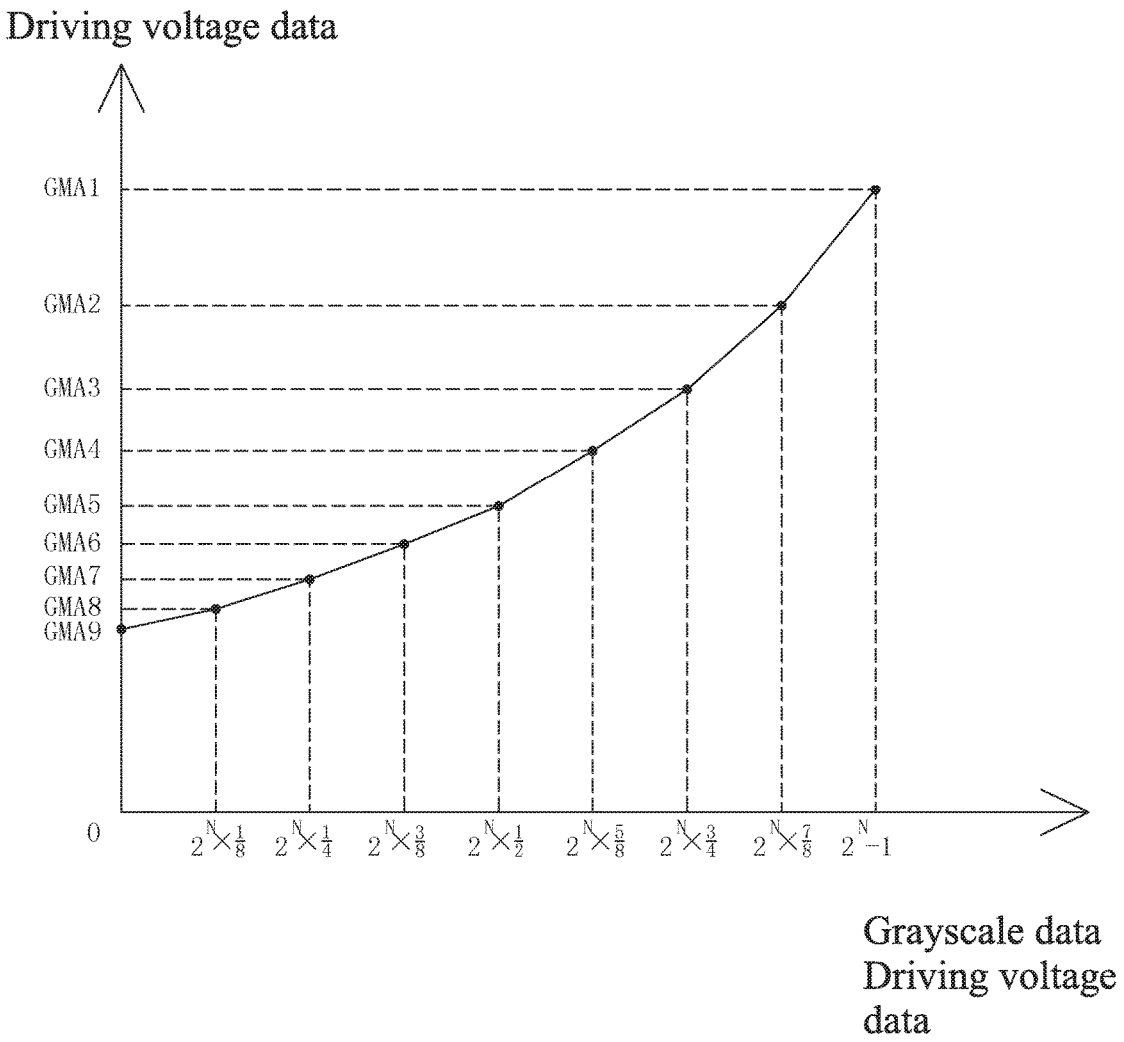
FIG. 4 is a flowchart of the step S1 of the compensation method for AMOLED display according to the present invention.
Figure 5:
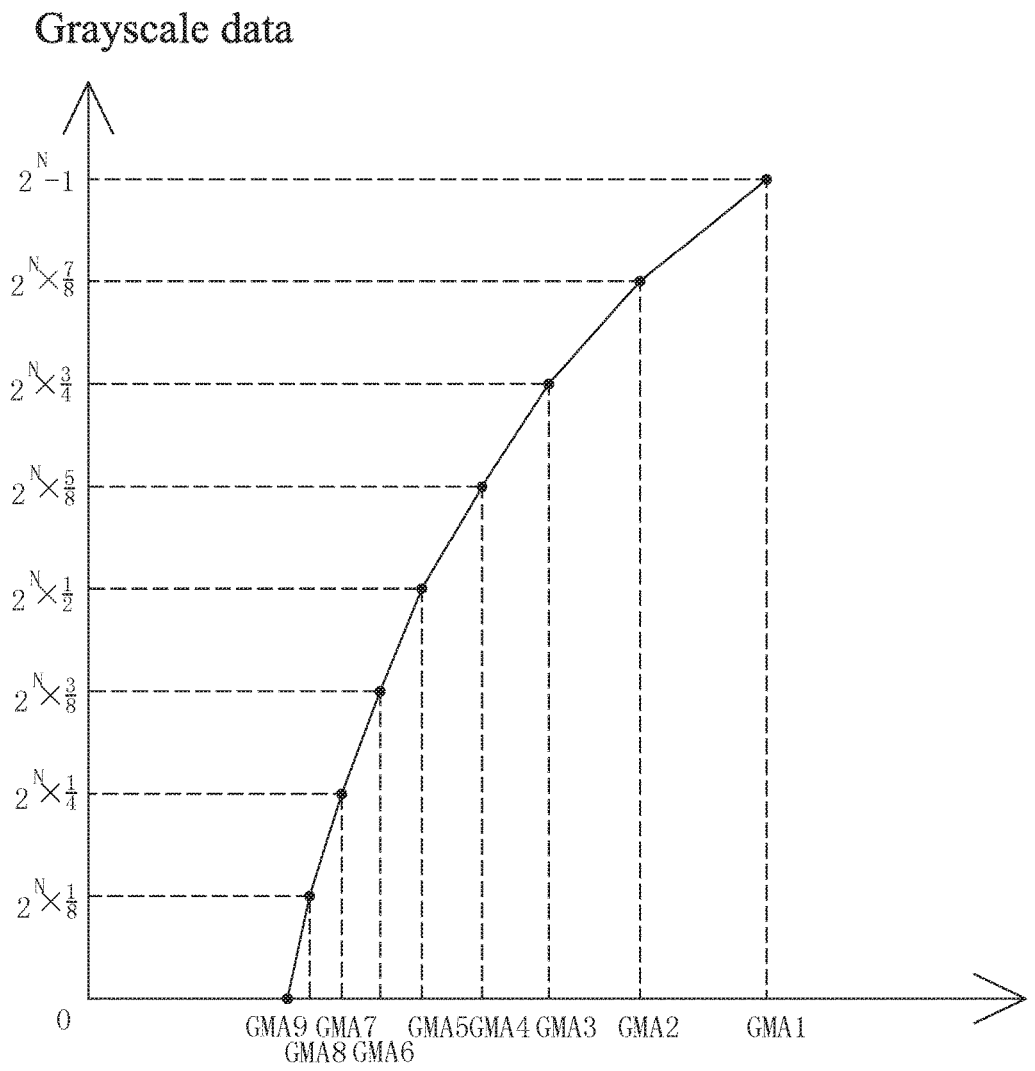
FIG. 5 is a flowchart of the step S3 of the compensation method for AMOLED display according to the present invention.

Specifically, please refer to FIGS. 4-5, the grayscale data conversion unit 100 and the voltage data conversion unit 400 both store a plurality of binding point grayscales and a plurality of binding point voltage data respectively corresponding to the plurality of binding point grayscales.

Preferably, the grayscale data conversion unit 100 and the voltage data conversion unit 400 both store 9 binding point grayscales and 9 binding point voltage data respectively corresponding to the 9 binding point grayscales; the 9 binding point grayscales are respectively $2^N$—1, $2^N$×⅞, $2^N$×¾, $2^N$×⅝, $2^N$×½, $2^N$×⅜, $2^N$×¼, $2^N$×⅛, and 0. N is a positive integer, a bit width of the initial grayscale data is N bit. The 9 binding point voltage data are: a first binding point voltage data. GMA1, a second binding point voltage data GMA2, a third binding point voltage data GMA3, a fourth binding point voltage data GMA4, a fifth binding point voltage data GMA5, a sixth binding point voltage data GMA6, a seventh binding point voltage data GMA7, an eighth binding point voltage data GMA8, and a ninth binding point voltage data GMA9, which are sequentially decreasing.

Figure 6:
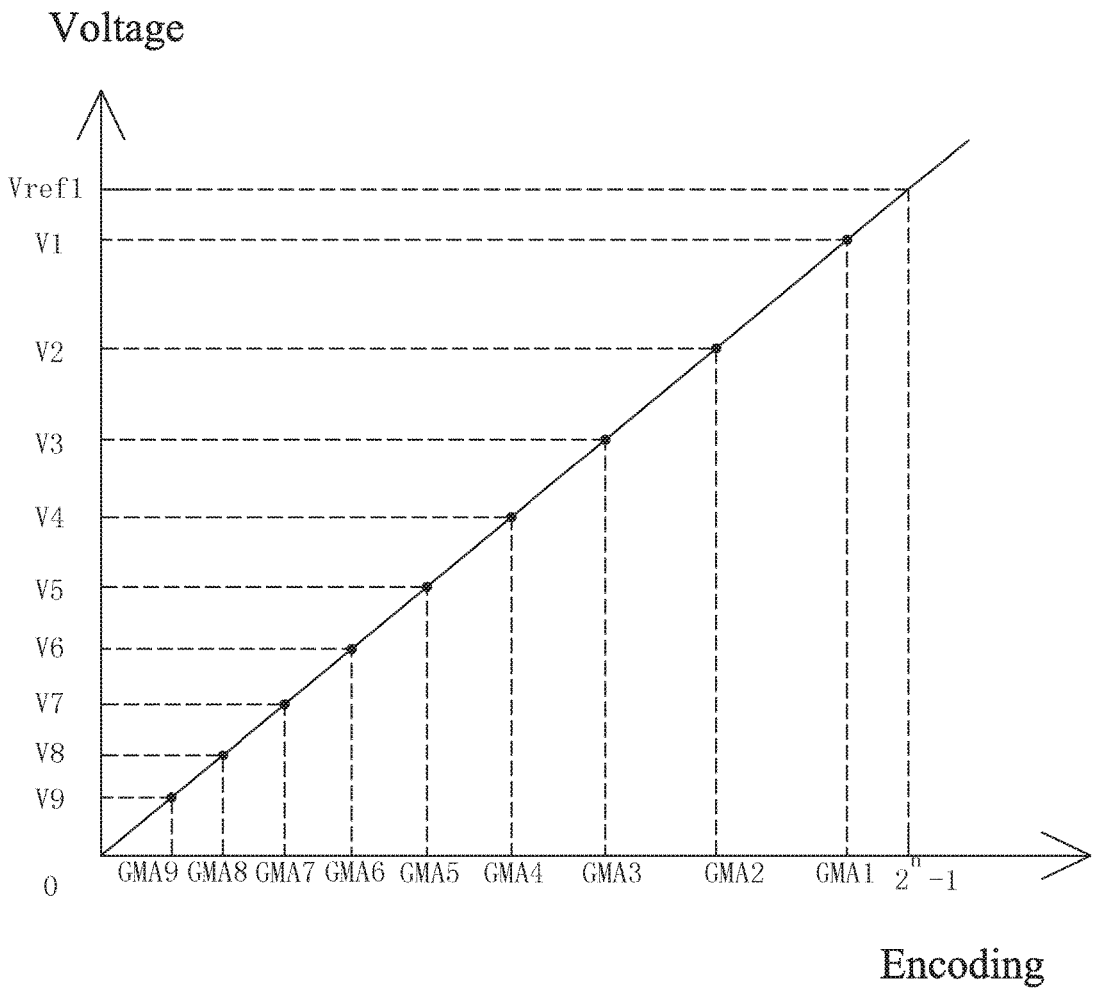
FIG. 6 is an illustrative diagram of encoding the binding point voltage of the compensation method for AMOLED display according to the present invention.

Furthermore, please refer to FIG. 6, the first binding point voltage data GMA1, the second binding point voltage data GMA2, the third binding point voltage data GMA3, the fourth binding point voltage data GMA4, the fifth binding point voltage data GMA5, the sixth binding point voltage data GMA6, the seventh binding point voltage data GMA7, an eighth binding point voltage data GMA8, and the ninth binding point voltage data GMA9 are derived by respectively encoding a first binding point voltage, a second binding point voltage, a third binding point voltage, a fourth binding point voltage, a fifth binding point voltage, a sixth binding point voltage, a seventh binding point voltage, an eighth binding point voltage, and a ninth binding point voltage, which are corresponding to $2^N$−1, $2^N$×⅞, $2^N$×¾, $2^N$×⅝, $2^N$×½, $2^N$×⅜, $2^N$×¼, $2^N$×⅛, and 0. An encoding range, an encoding step, an encoding bit width, and Vref1 of the first binding point voltage, the second binding point voltage, the third binding point voltage, the fourth binding point voltage, the fifth binding point voltage, the sixth binding point voltage, the seventh binding point voltage, the eighth binding point voltage, and the ninth binding point voltage are 0−Vref1, Vref1/$2^n$, n bit without signed number, and a first preset reference voltage, which can be specifically selected according to the maximum driving voltage of the pixel. n is a positive integer, which can be specifically selected according to the required compensation precision.

Figure 7:
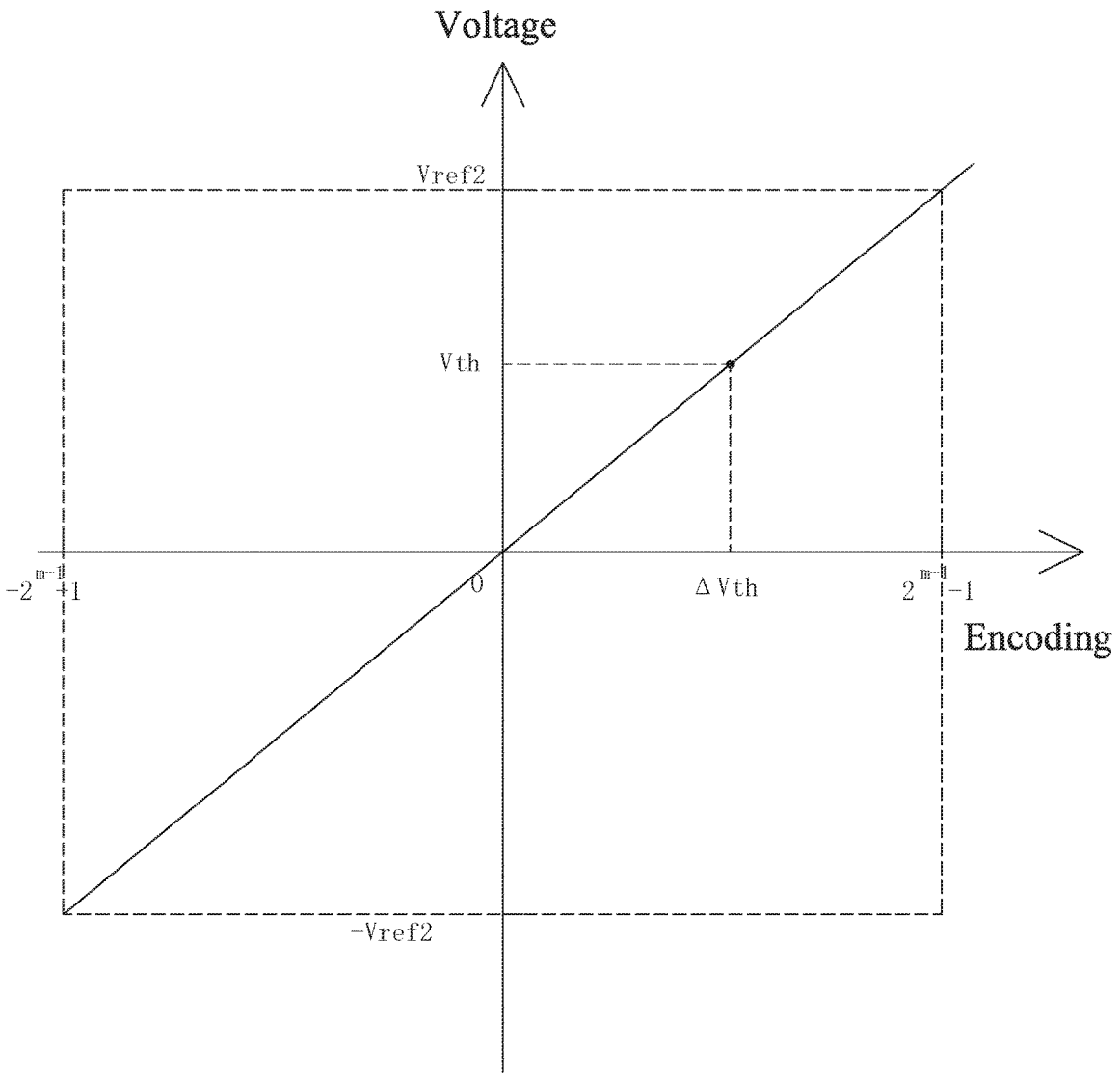
FIG. 7 is an illustrative diagram of encoding the compensation voltage of the compensation method for AMOLED display according to the present invention.

Specifically, please refer to FIG. 7, the compensation voltage data ΔVth is obtained by encoding a preset compensation voltage Vth.

Furthermore, An encoding range, the encoding step, an encoding bit width, and Vref2 of the preset compensation voltage are −Vref2−Vref2, Vref2/$2^{m-1}$, m bit with signed numbers, and a second preset reference voltage, which can be specifically selected according to the maximum driving voltage of the pixel. m is a positive integer.

It is needed to be noted that the encoding step of the first binding point voltage V1, the second binding point voltage V2, the third binding point voltage V3, the fourth binding point voltage V4, the fifth binding point voltage V5, the sixth binding point voltage V6, the seventh binding point voltage V7, the eighth binding point voltage V8, and the ninth binding point voltage V9 is the same as an encoding step of the preset compensation voltage Vth. In other words, Vref1/$2^n$=Vref2/$2^{m-1}$, Vref1/Vref2=$2^{n-m+1}$, so when the first preset reference voltage, the second preset reference voltage, and n are selected, m is selected accordingly.

Specifically, please refer to FIG. 4, after the initial grayscale data is received by the grayscale data converting unit 100. When the initial grayscale data is the same as one of the plurality of binding point grayscales, the grayscale data converting unit 100 outputs the binding point voltage data as the initial driving voltage data, the binding point voltage data is corresponding to the binding point grayscale which is the same as the initial grayscale data; and when the initial grayscale data and the plurality of binding point grayscales are not the same, the grayscale data conversion unit 100 linearly interpolates the two binding point voltage data corresponding to the two binding point grayscales adjacent to the initial grayscale data, the initial driving voltage data corresponding to the initial grayscale data is calculated and outputted.

Specifically, because the encoding steps of the first, second, third, fourth, fifth, sixth, seventh, eighth, ninth binding points voltages V1, V2, V3, V4, V5, V6, V7, V8, V9 The length is equal to the encoding step of the preset compensation voltage Vth, and the initial driving voltage data is obtained by the binding point voltage data corresponding to the first, second, third, fourth, fifth, sixth, seventh, eighth, ninth binding voltage V1, V2, V3, V4, V5, V6, V7, V8, V9, the encoding step of the initial driving voltage data is also equal to the encoding step of the preset compensation voltage Vth, so that when the compensation unit 200 compensates the initial driving voltage data by using the compensation ratio coefficient and the compensation voltage data ΔVth, the compensation voltage data ΔVth and the initial driving voltage data are complement-added for compensating the initial voltage data.

Specifically, please refer to FIG. 5, after the voltage data conversion unit 400 receives the compensation driving voltage data transmitted by the compensation unit 300. When the compensation driving voltage data is the same as one of the plurality of binding point voltage data, the voltage data converting unit 400 outputs the binding point grayscale as the compensation grayscale data to the source driver 500 of the AMOLED display, the binding point grayscale is corresponding to the binding point voltage data which is the same as the compensation grayscale data; and when the compensation driving voltage data and the plurality of binding point voltage data are not the same, the voltage data conversion unit linearly interpolates the two binding point grayscales corresponding to the two binding point voltage data adjacent to the compensation driving voltage data, the compensation grayscale data corresponding to the compensation driving voltage data is calculated and outputted to the source driver 500 of the AMOLED display.

It's needed to be noted that in the above compensation system for AMOLED display, the initial grayscale, data is converted into the initial driving voltage data corresponding to the initial grayscale data by the grayscale data converting unit 100; the compensation unit 200 compensates the initial driving voltage data by using the compensation ratio coefficient and the compensation voltage data in the compensation data storage unit and outputs the compensation driving voltage data to the voltage data conversion unit 300; the voltage data conversion unit 300 converts the compensation driving voltage data into the compensation grayscale data and outputs the compensation grayscale data to the source driver 500 of the AMOLED display for display of the AMOLED, to achieve an uniform compensation of the AMOLED display by compensating the initial driving voltage data, which is capable of reducing the required data amount of compensation. Meanwhile, because the grayscale data conversion unit 100 and the voltage data conversion unit 400 both store a plurality of binding point grayscales and a plurality of binding point voltage data respectively corresponding to the plurality of binding point grayscales, when the initial grayscale data is converted to the initial driving voltage data, if the initial grayscale data and the plurality of binding point grayscales are not the same, an initial driving voltage data corresponding to the initial grayscale data are derived by linearly interpolation; the same as above, when the compensation driving voltage data is converted to the compensation grayscale data, if the compensation driving voltage data and the plurality of binding point voltage data are not the same, the compensation grayscale data corresponding to the compensation driving voltage data by linearly interpolation. It is possible to set fewer binding point grayscales and binding point voltage data, which can effectively reduce the data amount of converting the initial grayscale data into the initial driving voltage data and converting the compensation driving voltage data to compensation grayscale data, so as to reduce the storage space for storing data and reduce the cost. Further, with setting the encoding step of the binding point voltage to be the same as the encoding step of the preset compensation voltage, so that when the initial driving voltage data is compensated, the initial driving voltage data and the compensation voltage data may be directly complement-added, which can effectively reduce the complexity of the compensation operation.

Please refer to FIG. 3, and FIGS. 4-7, the present invention further provides a compensation method for an AMOLED display, which is applied to the compensation system of the above AMOLED display. No repetitive description is made on the structure of the AMOLED display here. The compensation method for AMOLED display comprises the following steps:

Step S1, the initial grayscale data is inputted to the grayscale data conversion unit 100, the initial grayscale data is converted into the initial driving voltage data corresponding to the initial grayscale data by the grayscale data conversion unit 100, and is transmitted to the compensation unit 200.

Specifically, please refer to FIGS. 4-5, the grayscale data conversion unit 100 and the voltage data conversion unit 400 both store a plurality of binding point grayscales and a plurality of binding point voltage data respectively corresponding to the plurality of binding point grayscales.

Preferably, the grayscale data conversion unit 100 and the voltage data conversion unit 400 both store 9 binding point grayscales and 9 binding point voltage data respectively corresponding to the 9 binding point grayscales; the 9 binding point grayscales are respectively $2^N-1$, $2^N\times 7/8$, $2^N\times 3/4$, $2^N\times 5/8$, $2^N\times 1/2$, $2^N\times 3/8$, $2^N\times 1/4$, $2^N\times 1/8$, and 0. N is a positive integer, a bit width of the initial grayscale data is N bit. The 9 binding point voltage data are: a first binding point voltage data GMA1, a second binding point voltage data GMA2, a third binding point voltage data GMA3, a fourth binding point voltage data GMA4, a fifth binding point voltage data GMA5, a sixth binding point voltage data GMA6, a seventh binding point voltage data GMA7, an eighth binding point voltage data GMA8, and a ninth binding point voltage data GMA9, which are sequentially decreasing.

Furthermore, please refer to FIG. 6, the first binding point voltage data GMA1, the second binding point voltage data GMA2, the third binding point voltage data GMA3, the fourth binding point voltage data GMA4, the fifth binding point voltage data GMA5, the sixth binding point voltage data GMA6, the seventh binding point voltage data GMA7, an eighth binding point voltage data GMA8, and the ninth binding point voltage data GMA9 are derived by respectively encoding a first binding point voltage V1, a second binding point voltage V2, a third binding point voltage V3, a fourth binding point voltage V4, a fifth binding point voltage V5, a sixth binding point voltage V6, a seventh binding point voltage V7, an eighth binding point voltage V8, and a ninth binding point voltage V9, which are corresponding to $2^N-1$, $2^N\times 7/8$, $2^N\times 3/4$, $2^N\times 5/8$, $2^N\times 1/2$, $2^N\times 3/8$, $2^N\times 1/4$, $2^N\times 1/8$, and 0. An encoding range, an encoding step, an encoding bit width, and Vref1 of the first binding point voltage V1, the second binding point voltage V2, the third binding point voltage V3, the fourth binding point voltage V4, the fifth binding point voltage V5, the sixth binding point voltage V6, the seventh binding point voltage V7, the eighth binding point voltage V8, and the ninth binding point voltage V9 are 0–Vref1, $\text{Vref1}/2^n$, n bit without signed number, and a first preset reference voltage, which can be specifically selected according to the maximum driving voltage of the pixel. n is a positive integer, which can be specifically selected according to the required compensation precision.

Specifically, please refer to FIG. 7, the compensation voltage data ΔVth is obtained by encoding a preset compensation voltage Vth.

Furthermore, An encoding range, the encoding step, an encoding bit width, and Vref2 of the preset compensation voltage are –Vref2–Vref2, $\text{Vref2}/2^{m-1}$, m bit with signed numbers, and a second preset reference voltage, which can be specifically selected according to the maximum driving voltage of the pixel. m is a positive integer.

It is needed to be noted that the encoding step of the first binding point voltage V1, the second binding point voltage V2, the third binding point voltage V3, the fourth binding point voltage V4, the fifth binding point voltage V5, the sixth binding point voltage V6, the seventh binding point voltage V7, the eighth binding point voltage V8, and the ninth binding point voltage V9 is the same as an encoding step of the preset compensation voltage Vth. In other words, $\text{Vref1}/2^n=\text{Vref2}/2^{m-1}$, $\text{Vref1}/\text{Vref2}=2^{n-m+1}$, so when the first preset reference voltage, the second preset reference voltage, and n are selected, m is selected accordingly.

Specifically, please refer to FIG. 4, in the step S1, after the initial grayscale data is received by the grayscale data converting unit 100. When the initial grayscale data is the same as one of the plurality of binding point grayscales, the grayscale data converting unit 100 outputs the binding point voltage data as the initial driving voltage data, the binding point voltage data is corresponding to the binding point grayscale which is the same as the initial grayscale data; and when the initial grayscale data and the plurality of binding point grayscales are not the same, the grayscale data conversion unit 100 linearly interpolates the two binding point voltage data corresponding to the two binding point grayscales adjacent to the initial grayscale data, the initial driving voltage data corresponding to the initial grayscale data is calculated and outputted.

Step S2, the initial driving voltage data is compensated by using the compensation ratio coefficient and the compensation voltage data ΔVth in the compensation data storage unit 300 with the compensation unit 200, and the compensation driving voltage data is outputted to the voltage data conversion unit 400.

Specifically, because the encoding steps of the first, second, third, fourth, fifth, sixth, seventh, eighth, ninth binding points voltages V1, V2, V3, V4, V5, V6, V7, V8, V9 The length is equal to the encoding step of the preset compensation voltage Vth, and the initial driving voltage data is obtained by the binding point voltage data corresponding to the first, second, third, fourth, fifth, sixth, seventh, eighth, ninth binding voltage V1, V2, V3, V4, V5, V6, V7, V8, V9, the encoding step of the initial driving voltage data is also equal to the encoding step of the preset compensation voltage Vth. Therefore in the step S2, when the compensation unit 200 compensates the initial driving voltage data by using the compensation ratio coefficient and the compensation voltage data ΔVth, the compensation voltage data ΔVth and the initial driving voltage data are complement-added for compensating the initial voltage data.

Step S3, the compensation driving voltage data is converted into the compensation grayscale data by the voltage data conversion unit 400, and is outputted to the source driver 500 of the AMOLED display.

Specifically, please refer to FIG. 5, in the step S3, after the voltage data conversion unit 400 receives the compensation driving voltage data transmitted by the compensation unit 300. When the compensation driving voltage data is the same as one of the plurality of binding point voltage data, the voltage data converting unit 400 outputs the binding point grayscale as the compensation grayscale data, the binding point grayscale is corresponding to the binding point voltage data which is the same as the compensation grayscale data; and when the compensation driving voltage data and the plurality of binding point voltage data are not the same, the voltage data conversion unit linearly interpolates the two binding point grayscales corresponding to the two binding point voltage data adjacent to the compensation driving voltage data, the compensation grayscale data corresponding to the compensation driving voltage data is calculated and outputted.

It's needed to be noted that in the above compensation method for AMOLED display, the initial grayscale data is converted into the initial driving voltage data corresponding to the initial grayscale data by the grayscale data converting unit 100; the compensation unit 200 compensates the initial driving voltage data by using the compensation ratio coefficient and the compensation voltage data in the compensation data storage unit and outputs the compensation driving voltage data to the voltage data conversion unit 300; the voltage data conversion unit 300 converts the compensation driving voltage data into the compensation grayscale data and outputs the compensation grayscale data to the source driver 500 of the AMOLED display for display of the AMOLED, to achieve an uniform compensation of the AMOLED display by compensating the initial driving voltage data, which is capable of reducing the required data amount of compensation. Meanwhile, because the grayscale data conversion unit 100 and the voltage data conversion unit 400 both store a plurality of binding point grayscales and a plurality of binding point voltage data respectively corresponding to the plurality of binding point grayscales, when the initial grayscale data is converted to the initial driving voltage data, if the initial grayscale data and the plurality of binding point grayscales are not the same, an initial driving voltage data corresponding to the initial grayscale data are derived by linearly interpolation; the same as above, when the compensation driving voltage data is converted to the compensation grayscale data, if the compensation driving voltage data and the plurality of binding point voltage data are not the same, the compensation grayscale data corresponding to the compensation driving voltage data by linearly interpolation. It is possible to set fewer binding point grayscales and binding point voltage data, which can effectively reduce the data amount of converting the initial grayscale data into the initial driving voltage data and converting the compensation driving voltage data to compensation grayscale data, so as to reduce the storage space for storing data and reduce the cost. Further, with setting the encoding step of the binding point voltage to be the same as the encoding step of the preset compensation voltage, so that when the initial driving voltage data is compensated, the initial driving voltage data and the compensation voltage data may be directly complement-added, which can effectively reduce the complexity of the compensation operation.

As mentioned above, in the compensation system for AMOLED display of the present invention, the initial grayscale data is inputted into the grayscale data converting unit, the initial grayscale data is converted into the initial driving voltage data corresponding to the initial grayscale data by the grayscale data converting unit, and the initial grayscale data is transmitted to the compensation unit; the compensation unit compensates the initial driving voltage data by using the compensation ratio coefficient and the compensation voltage data in the compensation data storage unit and outputs the compensation driving voltage data to the voltage data conversion unit; the voltage data conversion unit then converts the compensation driving voltage data into the compensation grayscale data and outputs the compensation grayscale data to the source driver of the AMOLED display to uniformly compensate the AMOLED display by compensating the initial driving voltage data, which is capable of reducing the required data amount of compensation. The present invention provides a compensation method for AMOLED display, which is capable of achieving the uniform compensation to the AMOLED, and the required data amount of compensation is little.

As mentioned above, those of ordinary skill in the art, without departing from the spirit and scope of the present invention, can make various kinds of modifications and variations to the present invention. Therefore, all such modifications and variations are intended to be included in the protection scope of the appended claims of the present invention.

What is claimed is:

1. A compensation system for active-matrix organic light-emitting diode (AMOLED) display, comprising a grayscale data conversion unit, a compensation unit electrically connected with the grayscale data conversion unit, a compensation data storage unit electrically connected with the compensation unit, a voltage data conversion unit electrically connected with the compensation unit; wherein the voltage data conversion unit is electrically connected with a source driver of the AMOLED display; the compensation data storage unit stores compensation voltage data and compensation ratio coefficient; wherein:

the grayscale data converting unit being configured to input initial grayscale data and convert the initial grayscale data into initial driving voltage data corresponding to the initial grayscale data and transmit the initial driving voltage data to the compensation unit;

the compensation unit being configured to compensate the initial driving voltage data transmitted by the grayscale data conversion unit by using the compensation ratio coefficient and the compensation voltage data in the compensation data storage unit and output the compensation driving voltage data to the voltage data conversion unit;

the voltage data conversion unit being configured to convert the compensation driving voltage data transmitted by the compensation unit into compensation grayscale data and output the compensation grayscale data to the source driver of the AMOLED display.

2. The compensation system for AMOLED display according to claim 1, wherein the grayscale data conversion unit and the voltage data conversion unit both store a plurality of binding point grayscales and a plurality of binding point voltage data respectively corresponding to the plurality of binding point grayscales;

after the initial grayscale data is received by the grayscale data converting unit, when the initial grayscale data is the same as one of the plurality of binding point grayscales, the grayscale data converting unit outputs the binding point voltage data as the initial driving voltage data, the binding point voltage data is corresponding to the binding point grayscale which is the same as the initial grayscale data, and when the initial grayscale data and the plurality of binding point grayscales are not the same, the grayscale data conversion unit linearly interpolates the two binding point voltage data corresponding to the two binding point grayscales adjacent to the initial grayscale data, the initial driving voltage data corresponding to the initial grayscale data is calculated and outputted;

after the voltage data conversion unit receives the compensation driving voltage data transmitted by the compensation unit, when the compensation driving voltage data is the same as one of the plurality of binding point voltage data, the voltage data converting unit outputs the binding point grayscale as the compensation grayscale data to the source driver of the AMOLED display, the binding point grayscale is corresponding to the binding point voltage data which is the same as the compensation grayscale data, and when the compensation driving voltage data and the plurality of binding point voltage data are not the same, the voltage data conversion unit linearly interpolates the two binding point grayscales corresponding to the two binding point voltage data adjacent to the compensation driving voltage data, the compensation grayscale data corresponding to the compensation driving voltage data is calculated and outputted to the source driver of the AMOLED display.

3. The compensation system for AMOLED display according to claim 2, wherein the grayscale data conversion unit and the voltage data conversion unit both store 9 binding point grayscales and 9 binding point voltage data respectively corresponding to the 9 binding point grayscales; the 9 binding point grayscales are respectively $2^N-1$, $2^N\times 7/8$, $2^N\times 3/4$, $2^N\times 5/8$, $2^N\times 1/2$, $2^N\times 3/8$, $2^N\times 1/4$, $2^N\times 1/8$, and 0, wherein N is a positive integer, a bit width of the initial grayscale data is N bit, the 9 binding point voltage data are: a first binding point voltage data, a second binding point voltage data, a third binding point voltage data, a fourth binding point voltage data, a fifth binding point voltage data, a sixth binding point voltage data, a seventh binding point voltage data, an eighth binding point voltage data, and a ninth binding point voltage data, which are sequentially decreasing.

4. The compensation system for AMOLED display according to claim 3, wherein the first binding point voltage data, the second binding point voltage data, the third binding point voltage data, the fourth binding point voltage data, the fifth binding point voltage data, the sixth binding point voltage data, the seventh binding point voltage data, the eighth binding point voltage data, and the ninth binding point voltage data are derived by respectively encoding a first binding point voltage, a second binding point voltage, a third binding point voltage, a fourth binding point voltage, a fifth binding point voltage, a sixth binding point voltage, a seventh binding point voltage, an eighth binding point voltage, and a ninth binding point voltage, which are corresponding to $2^N-1$, $2^N\times 7/8$, $2^N\times 3/4$, $2^N\times 5/8$, $2^N\times 1/2$, $2^N\times 3/8$, $2^N\times 1/4$, $2^N\times 1/8$, and 0; an encoding range, an encoding step, an encoding bit width, and Vref1 of the first binding point voltage, the second binding point voltage, the third binding point voltage, the fourth binding point voltage, the fifth binding point voltage, the sixth binding point voltage, the seventh binding point voltage, the eighth binding point voltage, and the ninth binding point voltage are 0–Vref1, $\text{Vref1}/2^n$, n bit without signed number, and a first preset reference voltage; wherein n is a positive integer.

5. The compensation system for AMOLED display according to claim 4, wherein the compensation voltage data is obtained by encoding a preset compensation voltage, the encoding step of the first binding point voltage, the second binding point voltage, the third binding point voltage, the fourth binding point voltage, the fifth binding point voltage, the sixth binding point voltage, the seventh binding point voltage, the eighth binding point voltage, and the ninth binding point voltage is the same as an encoding step of the preset compensation voltage.

6. The compensation system for AMOLED display according to claim 5, wherein an encoding range, the encoding step, an encoding bit width, and Vref2 of the preset compensation voltage are –Vref2–Vref2, $\text{Vref2}/2^{m-1}$, m bit with signed numbers, and a second preset reference voltage; m is a positive integer.

7. The compensation system for AMOLED display according to claim 6, wherein when the compensation unit compensates the initial driving voltage data transmitted by the grayscale data conversion unit by using the compensation ratio coefficient and the compensation voltage data, the compensation voltage data and the initial driving voltage data are complement-added.

8. A compensation method for AMOLED display, which is applied in the compensation system for AMOLED display according to claim 1, comprising:

step S1, inputting the initial grayscale data to the grayscale data conversion unit, converting the initial grayscale data into the initial driving voltage data corresponding to the initial grayscale data by the grayscale data conversion unit, and transmitting to the compensation unit;

step S2, compensating the initial driving voltage data by using the compensation ratio coefficient and the compensation voltage data in the compensation data storage unit with the compensation unit, outputting the compensation driving voltage data to the voltage data conversion unit;

step S3, converting the compensation driving voltage data into the compensation grayscale data by the voltage data conversion unit, outputting to the source driver of the AMOLED display.

9. A compensation system for active-matrix organic light-emitting diode (AMOLED) display, comprising a grayscale data conversion unit, a compensation unit electrically connected with the grayscale data conversion unit, a compensation data storage unit electrically connected with the compensation unit, a voltage data conversion unit electrically connected with the compensation unit; wherein the voltage data conversion unit is electrically connected with a source driver of the AMOLED display; the compensation data storage unit stores compensation voltage data and compensation ratio coefficient; wherein:

the grayscale data converting unit being configured to input initial grayscale data and convert the initial grayscale data into initial driving voltage data corresponding to the initial grayscale data and transmit the initial driving voltage data to the compensation unit;

the compensation unit being configured to compensate the initial driving voltage data transmitted by the grayscale data conversion unit by using the compensation ratio coefficient and the compensation voltage data in the compensation data storage unit and output the compensation driving voltage data to the voltage data conversion unit;

the voltage data conversion unit being configured to convert the compensation driving voltage data transmitted by the compensation unit into compensation grayscale data and output the compensation grayscale data to the source driver of the AMOLED display;

wherein the grayscale data conversion unit and the voltage data conversion unit both store a plurality of binding point grayscales and a plurality of binding point voltage data respectively corresponding to the plurality of binding point grayscales;

after the initial grayscale data is received by the grayscale data converting unit, when the initial grayscale data is the same as one of the plurality of binding point grayscales, the grayscale data converting unit outputs the binding point voltage data as the initial driving voltage data, the binding point voltage data is corresponding to the binding point grayscale which is the same as the initial grayscale data, and when the initial grayscale data and the plurality of binding point grayscales are not the same, the grayscale data conversion unit linearly interpolates the two binding point voltage data corresponding to the two binding point grayscales adjacent to the initial grayscale data, the initial driving voltage data corresponding to the initial grayscale data is calculated and outputted;

after the voltage data conversion unit receives the compensation driving voltage data transmitted by the compensation unit, when the compensation driving voltage data is the same as one of the plurality of binding point voltage data, the voltage data converting unit outputs the binding point grayscale as the compensation grayscale data to the source driver of the AMOLED display, the binding point grayscale is corresponding to the binding point voltage data which is the same as the compensation grayscale data, and when the compensation driving voltage data and the plurality of binding point voltage data are not the same, the voltage data conversion unit linearly interpolates the two binding point grayscales corresponding to the two binding point voltage data adjacent to the compensation driving voltage data, the compensation grayscale data corresponding to the compensation driving voltage data is calculated and outputted to the source driver of the AMOLED display;

wherein the grayscale data conversion unit and the voltage data conversion unit both store 9 binding point grayscales and 9 binding point voltage data respectively corresponding to the 9 binding point grayscales; the 9 binding point grayscales are respectively $2^N-1$, $2^N\times 7/8$, $2^N\times 3/4$, $2^N\times 5/8$, $2^N\times 1/2$, $2^N\times 3/8$, $2^N\times 1/4$, $2^N\times 1/8$, and 0, wherein N is a positive integer, a bit width of the initial grayscale data is N bit, the 9 binding point voltage data are: a first binding point voltage data, a second binding point voltage data, a third binding point voltage data, a fourth binding point voltage data, a fifth binding point voltage data, a sixth binding point voltage data, a seventh binding point voltage data, an eighth binding point voltage data, and a ninth binding point voltage data, which are sequentially decreasing;

wherein the first binding point voltage data, the second binding point voltage data, the third binding point voltage data, the fourth binding point voltage data, the fifth binding point voltage data, the sixth binding point voltage data, the seventh binding point voltage data, the eighth binding point voltage data, and the ninth binding point voltage data are derived by respectively encoding a first binding point voltage, a second binding point voltage, a third binding point voltage, a fourth binding point voltage, a fifth binding point voltage, a sixth binding point voltage, a seventh binding point voltage, an eighth binding point voltage, and a ninth binding point voltage, which are corresponding to $2^N-1$, $2^N\times 7/8$, $2^N\times 3/4$, $2^N\times 5/8$, $2^N\times 1/2$, $2^N\times 3/8$, $2^N\times 1/4$, $2^N\times 1/8$, and 0; an encoding range, an encoding step, an encoding bit width, and Vref1 of the first binding point voltage, the second binding point voltage, the third binding point voltage, the fourth binding point voltage, the fifth binding point voltage, the sixth binding point voltage, the seventh binding point voltage, the eighth binding point voltage, and the ninth binding point voltage are 0–Vref1, $Vref1/2^n$, n bit without signed number, and a first preset reference voltage; wherein n is a positive integer;

wherein the compensation voltage data is obtained by encoding a preset compensation voltage, the encoding step of the first binding point voltage, the second binding point voltage, the third binding point voltage, the fourth binding point voltage, the fifth binding point voltage, the sixth binding point voltage, the seventh binding point voltage, the eighth binding point voltage, and the ninth binding point voltage is the same as an encoding step of the preset compensation voltage.

10. The compensation system for AMOLED display according to claim 9, wherein an encoding range, the encoding step, an encoding bit width, and Vref2 of the preset compensation voltage are –Vref2–Vref2, $Vref2/2^{m-1}$, m bit with signed numbers, and a second preset reference voltage; m is a positive integer.

11. The compensation system for AMOLED display according to claim 10, wherein when the compensation unit compensates the initial driving voltage data transmitted by the grayscale data conversion unit by using the compensation ratio coefficient and the compensation voltage data, the compensation voltage data and the initial driving voltage data are complement-added.

* * * * *